US009750658B1

(12) United States Patent
Ware

(10) Patent No.: US 9,750,658 B1
(45) Date of Patent: Sep. 5, 2017

(54) GUITAR URN

(71) Applicant: Robert Athel Ware, Pryor, OK (US)

(72) Inventor: Robert Athel Ware, Pryor, OK (US)

( * ) Notice: Subject to any disclaimer, the term of this patent is extended or adjusted under 35 U.S.C. 154(b) by 0 days.

(21) Appl. No.: 15/347,964

(22) Filed: Nov. 10, 2016

Related U.S. Application Data

(63) Continuation-in-part of application No. 29/505,021, filed on Apr. 27, 2015, now abandoned.

(51) Int. Cl.
*A61G 17/08* (2006.01)

(52) U.S. Cl.
CPC ..... *A61G 17/08* (2013.01)

(58) Field of Classification Search
CPC ..... A61G 17/08; A61G 17/00; E04H 13/008; G10D 1/08
USPC ..... 27/1; D99/5; 84/267; 40/124.5
See application file for complete search history.

(56) References Cited

U.S. PATENT DOCUMENTS

| | | | | |
|---|---|---|---|---|
| D21,278 | S | 1/1892 | West | |
| 835,085 | A | 11/1906 | Webb | |
| D138,472 | S | 8/1944 | Gerson | |
| D163,837 | S | 7/1951 | Waldron | |
| 3,167,844 | A | 2/1965 | Bachofner | |
| 3,589,062 | A * | 6/1971 | Desmond | A63H 33/00 446/405 |
| D232,330 | S | 8/1974 | Cappadona | |
| 4,372,187 | A | 2/1983 | Berg | |
| D269,523 | S | 6/1983 | Burge | |
| D300,408 | S | 3/1989 | Couri | |
| 5,133,239 | A | 7/1992 | Thomas | |
| D384,093 | S | 9/1997 | Oshima | |
| 5,837,917 | A | 11/1998 | Macnab et al. | |
| 5,896,632 | A | 4/1999 | Sturino | |
| D420,694 | S | 2/2000 | Rose | |
| D423,753 | S | 4/2000 | Huber et al. | |
| 6,111,184 | A | 8/2000 | Cloud et al. | |
| D442,476 | S | 5/2001 | Davis | |
| D457,284 | S | 5/2002 | Dziekonski | |
| D474,572 | S | 5/2003 | Fitzmaurice | |
| 6,763,558 | B1 | 7/2004 | Mytych | |
| D499,961 | S | 12/2004 | Wilson | |
| 6,911,590 | B2 | 6/2005 | Childress | |
| 6,951,280 | B1 * | 10/2005 | Lee | A45C 9/00 206/14 |
| D524,510 | S | 7/2006 | Adams | |
| 7,465,870 | B1 * | 12/2008 | Homan | A63J 7/00 84/293 |
| D584,984 | S | 1/2009 | Morris | |
| 7,950,117 | B2 * | 5/2011 | Elhaj | A61G 17/08 27/1 |
| 8,193,771 | B2 * | 6/2012 | Coccio | G01R 31/3634 320/132 |

(Continued)

*Primary Examiner* — William Miller
(74) *Attorney, Agent, or Firm* — Head, Johnson, Kachigian & Wilkinson, PC

(57) ABSTRACT

A guitar-shaped urn suitable for holding and/or displaying the ashes of a guitar player or guitar-enthusiast. The urn may comprise a generally guitar-shaped body, a heart-shaped chamber within the body, an opening into the chamber, and a cover for the opening, such that when the cover is in place, the chamber is generally sealed. The urn may have typical guitar features, such as strings, a fret board, and a bridge. The urn may be functional only as an urn, with the guitar features merely decorative, or the urn may be functional additionally as a guitar.

7 Claims, 5 Drawing Sheets

(56) References Cited

U.S. PATENT DOCUMENTS

| | | | | |
|---|---|---|---|---|
| 8,281,465 | B1 * | 10/2012 | Miraldi | A61G 17/08 27/1 |
| 8,281,466 | B2 * | 10/2012 | Elhaj | A61G 17/08 27/1 |
| 8,907,198 | B2 * | 12/2014 | Juszkiewicz | G10H 3/18 84/644 |
| 9,093,057 | B2 * | 7/2015 | Mejia | G10H 1/02 |
| 9,117,431 | B1 * | 8/2015 | Rudes | G10H 1/32 |
| 9,324,307 | B1 * | 4/2016 | Castillo | G10D 3/00 |
| 2005/0006267 | A1 * | 1/2005 | Lam | B65D 81/365 206/457 |
| 2006/0059669 | A1 * | 3/2006 | Rose | A61G 17/007 27/1 |

* cited by examiner

GUITAR URN

BACKGROUND OF THE INVENTION

Cross Reference

This is based on and claims priority to U.S. application Ser. No. 29/505,021 filed Apr. 27, 2015, which is incorporated by reference herein.

Field of the Invention

This invention relates generally to an urn and more particularly, but not by way of limitation, to a guitar-shaped urn.

Description of the Related Art

Cremated ashes are often kept in funerary urns. This is particularly true when someone wishes to keep a loved one's ashes in their home. Urns are often put on display, either on particular days, for particular events, or year-round. Urns are also used to hold ashes for burial. Sometimes ashes are held in an urn for display during a memorial service or prior to scattering. Urns are often vase-shaped with a tight-fitting lid, and often are immediately recognizable as an urn. Options are limited for urns that particularly suit the interests or personality of the person whose ashes are held therein, or for urns that are not immediately recognizable as urns.

Based on the foregoing, it is desirable to provide an urn that is shaped like a miniature guitar. This is particularly desirable for holding the ashes of a guitar player or guitar-enthusiast.

It is further desirable for the guitar urn to be functional as an urn.

It is further desirable for the guitar urn optionally to be functional as a guitar.

It is further desirable for the guitar urn to be attractive and worthy of display.

SUMMARY OF THE INVENTION

In general, in a first aspect, the invention relates to an urn comprising: a body, where the body is generally guitar-shaped; a chamber within the body; an opening into the chamber, where the opening is the only access into the chamber; and a cover for the opening, such that when the cover is in place, the chamber is generally sealed. The body may have a front and a back, where the urn further comprises strings attached to the front of the body. The opening may be located in the back of the body. The chamber may be sufficiently large to hold the ashes of a cremated person. The urn may be capable of being played as a guitar.

The body may comprise: a front piece with a front face, a back face, and a perimeter approximating the outline of a guitar body; and a back piece with a front face, a back face, and a perimeter generally matching the perimeter of the front piece, where the front face of the back piece is attached to the back face of the front piece such that the perimeter of the front piece aligns with the perimeter of the back piece. The opening may comprise a channel from the chamber to the back face of the back piece, where the chamber is accessible only via the channel, and the cover may comprise a cover plate capable of being attached to the back piece over the channel such that the chamber is generally sealed. The urn may further comprise a recess in the back face of the back piece, where the recess surrounds the channel and where the cover plate fits within the recess. The urn may further comprise a neck extending upward from the front piece and a fret board attached to the neck. The chamber may be shaped like an inverted heart.

Figures 1A, 1B, 1C:
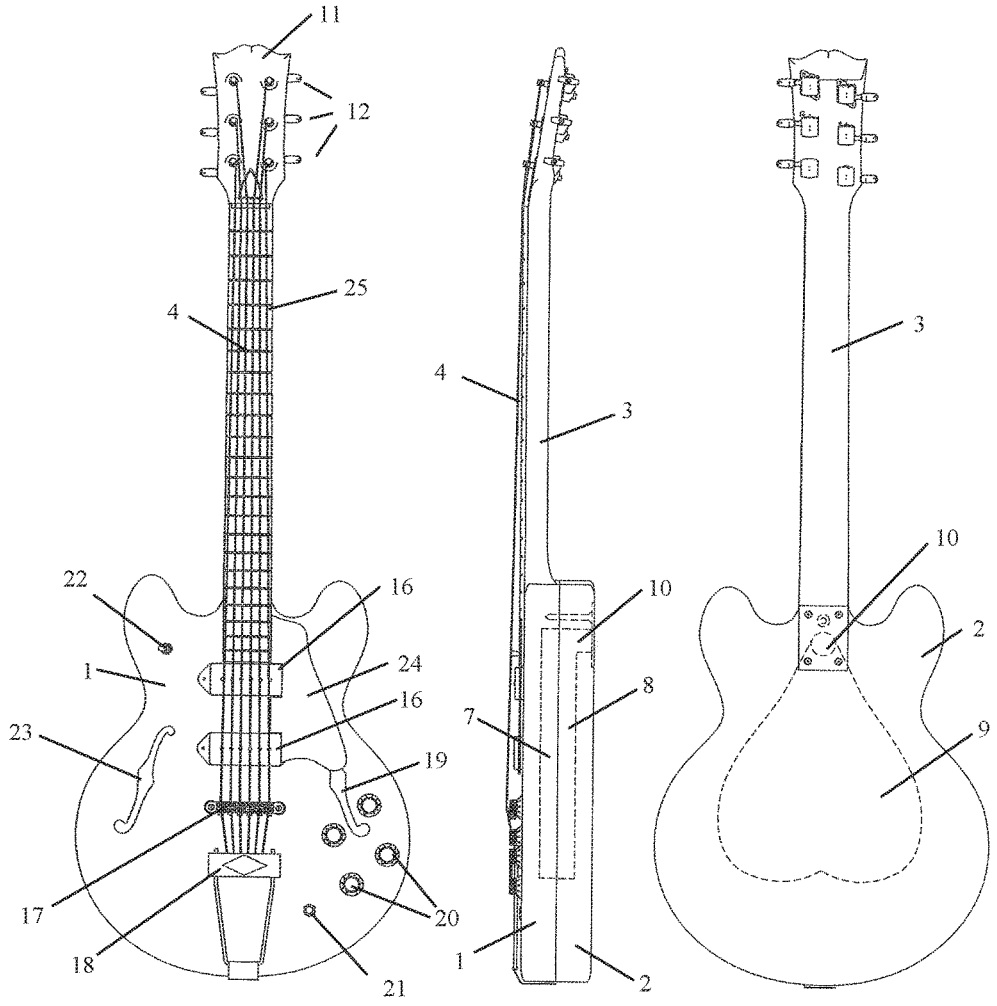
FIG. 1A is a front view of the guitar urn.
FIG. 1B is a side view of the guitar urn, with the inner chamber shown in dashed lines.
FIG. 1C is a back view of the guitar urn, with the inner chamber shown in dashed lines.
Figure 2:
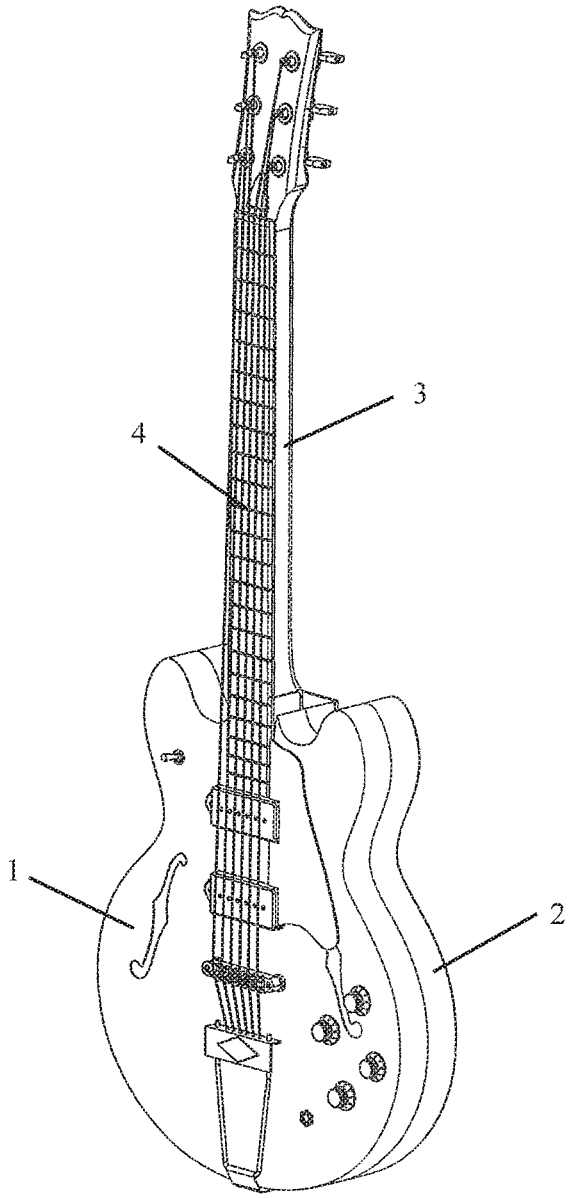
FIG. 2 is a front perspective view of the guitar urn.
Figure 3:
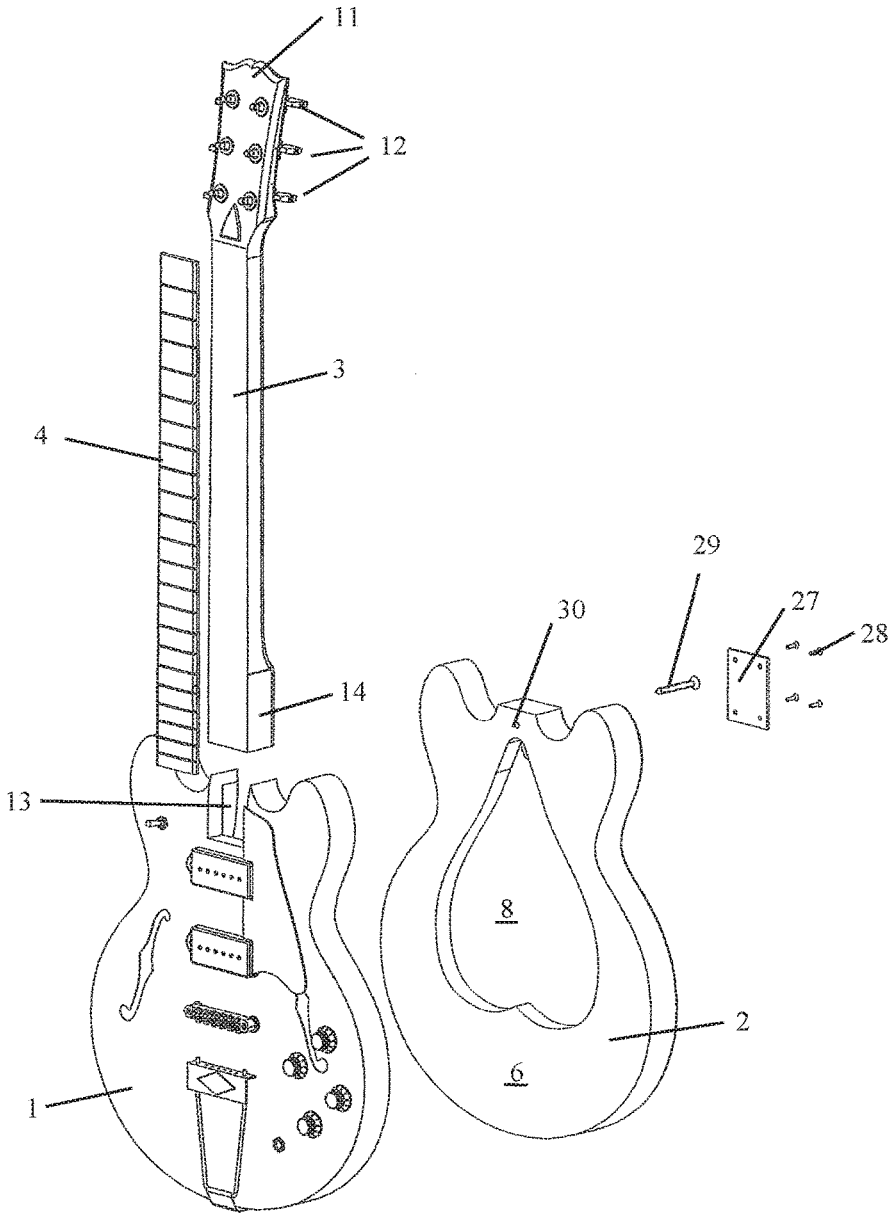
FIG. 3 is an exploded front perspective view of the guitar urn.
Figure 4:
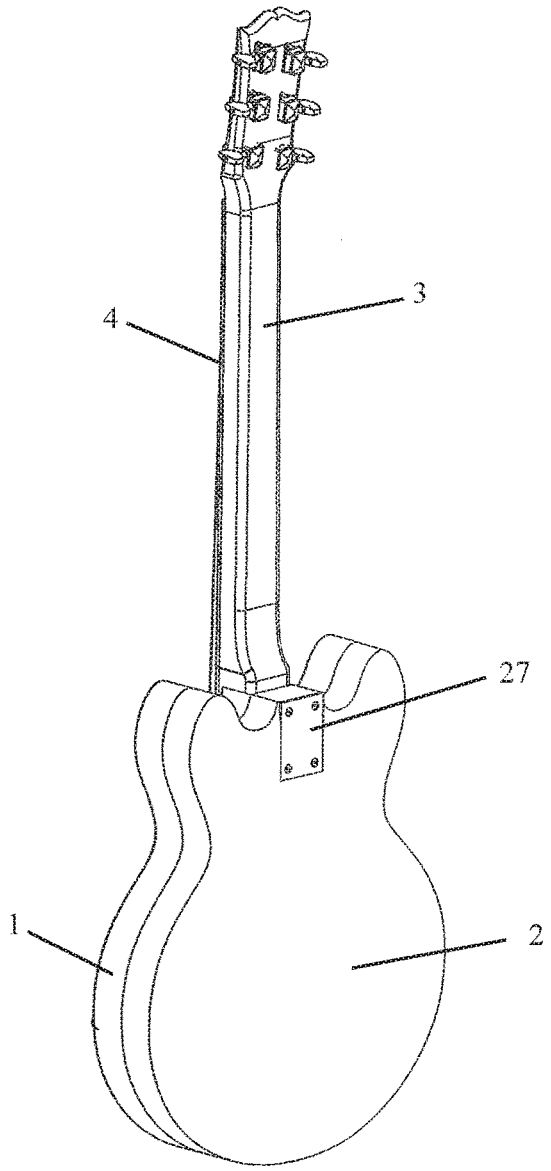
FIG. 4 is a back perspective view of the guitar urn.
Figure 5:
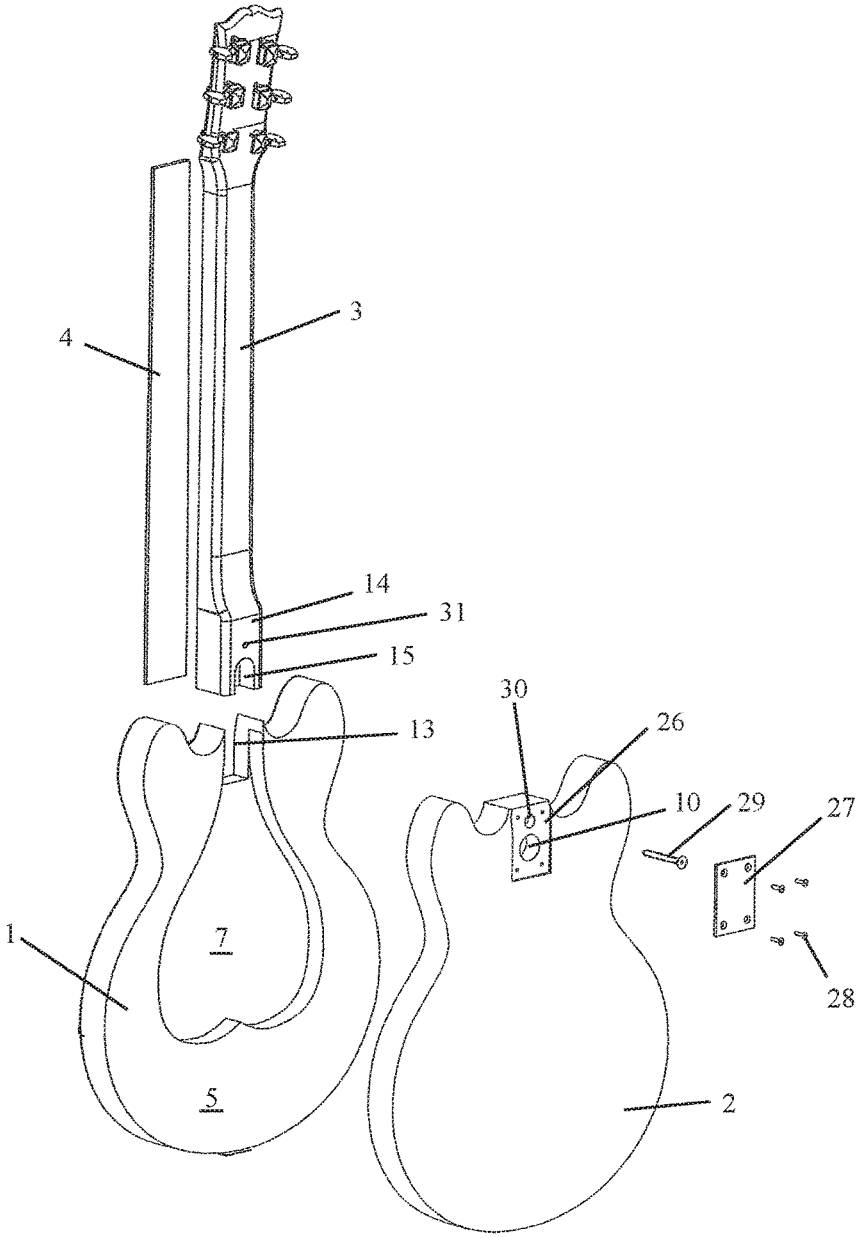
FIG. 5 is an exploded back perspective view of the guitar urn.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to an urn that is guitar-shaped. The urn may comprise a front piece 1, a back piece 2, a neck 3, and a fret board 4. The front piece 1 and back piece 2 may have the general outline of a guitar body. This outline may be that of an acoustic guitar or an electric guitar of any desired style, but the front piece 1 and the back piece 2 may share generally the same outline such that they may be placed together, the back face 5 of the front piece 1 against the front face 6 of the back piece 2, to form a unitary body. A cavity 7 in the back face 5 of the front piece 1 may generally align with a cavity 8 in the front face 6 of the back piece 2 to form a chamber 9 within the body of the guitar urn. A channel 10 extending from the cavity 8 out the back of the back face 5 may allow exterior access to the chamber 9. The chamber 9 may be otherwise inaccessible from outside the guitar urn when assembled. In particular, during assembly, the front piece 1 may be attached to the back piece 2 such that the chamber 9 is fully sealed form the exterior other than through the channel 10.

The neck 3 may be generally shaped like a guitar neck and may include a headstock 11 and tuners 12. The front piece 1 may have a dado 13 into which the base 14 of the neck 3 may fit. The base 14 of the neck 3 may itself have a dado 15 aligning with the channel 10 in the back piece 2 when the guitar urn is fully assembled, such that the dado 15 forms part of the chamber 9. Altogether, the chamber 9 formed by the cavity 7 in the front piece 1, the cavity 8 in the back piece 2, and the dado 15 in the neck 3 may be shaped like an inverted heart, as shown in the drawings.

The front piece 1 may be decorated to resemble a guitar. In particular, the front piece 1 may be decorated with one or more of the following: pickup 16, bridge 17, support 18, tremolo 19, nobs 20, jack 21, switch 22, f-hole 23, pick guard 24, etc. The fret board 4 may attach to the front of the neck 3, as in a typical guitar. Strings 25 may be added, stretching from the tuners 12 to the support 18. Thus, the guitar urn may resemble a typical guitar, whether acoustic or electric, with whatever design desired. The entire guitar urn may be miniature compared to a typical guitar. The guitar urn may be non-functional, as a guitar; in other words, the guitar urn may resemble a guitar but may not make music. Alternately, the guitar urn may be functional as a guitar. The parts may be of such quality and installed in such a way that the guitar urn may be played as a guitar.

The back of the back piece 2 may have a recess 26 surrounding the outlet of channel 10. A cover plate 27 may fit within the recess 26 to cover the channel 10. The recess 26 and the cover plate 27 may each be rectangular or any other desired shape. The recess 26 may have a depth matching the thickness of the cover plate 27, and the shape of the cover plate 27 may match the shape of the recess 26, such that the cover plate 27 fits flush within the recess 26. The cover plate 27 may attach to the back piece 2 via one or more attachment devices 28, such as four screws as shown. Alternately, the attachment devices 28 may be nails, bolts, adhesive, friction fit, or any other desired attachment device for attaching the cover plate 27 to the back piece 2. The back piece 2 may be attached to the neck 3 via an attachment device 29, which may be a screw, as shown, extending through a hole 30 in the recess 26 and into a hole 31 in the neck 3 above the dado 15.

During assembly, all parts except the cover plate 27 and attachment devices 28 may be assembled. The cover plate 27 may be removably attached to the back piece 2 if the attachment devices 28 are removable, or alternately the cover plate 27 may be initially left off of the guitar urn. During use, a user may insert ashes into the chamber 9 via the channel 10. Once the ashes are inside the chamber 9, the user may attach the cover plate 27 to the back piece 2 via the attachment devices 28, effectively sealing off the chamber 9 and ensuring that the ashes remain therein.

Whereas, the devices and methods have been described in relation to the drawings and claims, it should be understood that other and further modifications, apart from those shown or suggested herein, may be made within the spirit and scope of this invention.

What is claimed is:

1. An urn comprising:

a body, where the body is generally guitar-shaped, the body comprising:

a front piece with a front face, a back face, and a perimeter approximating the outline of a guitar body; and a back piece with a front face, a back face, and a perimeter generally matching the perimeter of the front piece, where the front face of the back piece is attached to the back face of the front piece such that the perimeter of the front piece aligns with the perimeter of the back piece;

a chamber within the body;

an opening into the chamber, where the opening is the only access into the chamber and where the opening comprises a channel from the chamber to the back face of the back piece, where the chamber is accessible only via the channel; and a cover for the opening, where the cover comprises a cover plate removably attached to the back piece over the channel such that when the cover is in place, the chamber is generally sealed.

2. The urn of claim 1, where the urn further comprises strings attached to the front face of the front piece of the body.

3. The urn of claim 1 where the chamber is sufficiently large to hold the ashes of a cremated person.

4. The urn of claim 1 where the urn is capable of being played as a guitar.

5. The urn of claim 1 further comprising a recess in the back face of the back piece, where the recess surrounds the channel and where the cover plate fits within the recess.

6. The urn of claim 1 further comprising:

a neck extending upward from the front piece; and a fret board attached to the neck.

7. The urn of claim 1 where the chamber is in the shape of an inverted heart.

* * * * *